US005522152A

United States Patent [19]

Woolsey

[11] Patent Number: 5,522,152

[45] Date of Patent: Jun. 4, 1996

[54] METHOD AND APPARATUS FOR DISCHARGING MATERIAL FROM A COOLER

[76] Inventor: Rick L. Woolsey, 1939 E. Sheridan Bridge La., Olathe, Kans. 66062

[21] Appl. No.: 327,380

[22] Filed: Oct. 21, 1994

[51] Int. Cl.[6] ..... F26B 17/12

[52] U.S. Cl. ..... 34/168; 34/175; 34/482

[58] Field of Search ..... 34/175, 168, 498, 34/482

[56] References Cited

U.S. PATENT DOCUMENTS

| | | | |
|---|---|---|---|
| 3,052,988 | 9/1962 | Knaust | 34/175 |
| 4,152,282 | 5/1979 | Westelaken | 34/168 |
| 4,445,282 | 5/1984 | Hoenemans | 34/168 |
| 4,869,162 | 9/1989 | Schouten | 34/168 |
| 5,375,342 | 12/1994 | Giesler | 34/168 |

*Primary Examiner*—John T. Kwon

*Attorney, Agent, or Firm*—Kokjer, Kircher, Bowman & Johnson

[57] ABSTRACT

A method and apparatus for discharging food or feed product from a cooler. Food or feed product may be introduced in a cooler formed of a large bin. The product is cooled by drawing a low volume of air having a high static pressure drop through the product. Trough-shaped gates are positionable beneath discharge openings in a lower portion of the bin to inhibit discharge of product. Product is intermittently discharged from the openings by selectively moving the gates at least partially away from the openings to permit product to flow through the openings. In preferred embodiments, a driver moves the gates intermittently in first and second directions by causing the gates to swing about a pivotal mounting point.

20 Claims, 3 Drawing Sheets

METHOD AND APPARATUS FOR DISCHARGING MATERIAL FROM A COOLER

BACKGROUND OF THE INVENTION

Field of the Invention

The present invention is generally directed to a cooler for granular products, such as pellets, and is more particularly directed to a discharge mechanism for a cooler of the type utilizing counter-flowing air through a hopper or bin to cool pelletized or particulate material therein. More specifically, a method and apparatus for discharging the particulate or pellets in the cooler intermittently interrupts the discharge flow of products through the use of swiveling gates positioned beneath outlet ports of the cooler.

Coolers are used in feed and food processing to cool pelletized or particulate products after they have been treated thermally, such as during pelleting, extrusion, drying, or other industrial processes.. One conventional type of cooler comprises a large bin. The feed or food material is introduced into the bin near the top, and is traditionally discharged into a hopper located beneath the bin. A fan at the top of the bin is used to draw a low volume of air having a high static pressure drop through the bottom of the bin, through the compacted feed or food material within the bin, and out the top. This counter-flowing air serves to cool the material.

The discharge area of coolers of this type traditionally have a series of fixed openings through which the cooled product may fall, usually into a hopper as described, or perhaps directly onto a conveyor or other mechanism for transferring the material to further processing stations or for packaging.

Cooler discharge mechanisms have previously been developed which periodically release feed or food material in the cooler through ports positioned at the bottom of the cooler. This is traditionally accomplished by a series of plates which are positioned so as to cover the discharge openings of the cooler, but which can be slid away from the opening to permit feed or food product to fall through the port. In other words, mechanisms have previously been developed which effectively form a horizontally oscillating slide gate discharge. With such discharge mechanisms, no product can flow when the plates are in the closed position, but when the plates are pulled away from the fixed openings, product can flow.

Removal of product dust from the cooler is particularly important between different uses of the cooler. For instance, after a first type of feed is cooled, such as chicken feed having certain antibiotics in the feed for chickens, a second application of the cooler, for instance for cooling pig feed, would necessitate removing any chicken feed dust from the cooler to prevent it from being mixed with the pig feed. In other words, dust is considered a contaminant, which can potentially be harmful to the persons or animals consuming the product.

There are numerous drawbacks associated with the discharge mechanisms described. One primary drawback of such discharge mechanisms is that the plates are slid horizontally away from the openings to permit product to discharge. However, when this is done, the plates slide along the bottom of the cooler, and namely the periphery of the fixed openings which, although serving to scrape product off of the plate and through the opening, causes wear on the plates. Additionally, since there is typically some product dust or small particulate in the product itself, it is virtually impossible to wipe all of the dust off of the plate as it opens. Moreover, in most applications it is not necessary to open the fixed openings entirely, but rather the plate is only moved so that a portion of the fixed opening is unobstructed. As a result, product tends to accumulate on the plate in proximity to the obstructed area of the opening, thereby adversely affecting material flow.

Accordingly, the need exists for a discharge mechanism for a cooler utilizing counter-flowing air which prevents product build-up and will allow complete discharge of product, including dust. The present invention overcomes the foregoing drawbacks and fills these and other needs.

Description of the Related Art

SUMMARY OF THE INVENTION

It is an object of the present invention to provide a method and apparatus for completely discharging product, including all or substantially all of dust and fines associated with the product, from the cooler.

It is an object of the present invention to provide a method and apparatus for discharging product from a cooler by intermittently obstructing and unobstructing fixed discharge openings of the cooler.

It is another object of the present invention to provide a discharge mechanism for a cooler having a gate pivoted so that it will swing such that in one position it covers an associated fixed discharge opening of the cooler thereby obstructing product flow, and in one or more other positions it is pivoted at least partially away from the discharge opening so that product may flow through the fixed openings and thereby be discharged from the cooler.

These and other objects are achieved by a new and novel method and apparatus for discharging material from a cooler. In a cooler having a bin in which feed or food products are cooled, the bin has a number of elongate fixed open channels at the bottom thereof through which feed or food material may be discharged. A discharge apparatus has a plurality of elongate trough-shaped gates. Each gate is associated with a fixed channel opening such that the gate, which is arcuate in shape such that its outer ends extend upwardly higher than its central-most portion, catches and thereby prohibits the product from flowing from its associated fixed opening when the gate is suspended in a rest position beneath the opening. Each gate may be simultaneously swung from its rest position about its pivotal connection point on a frame. The pivotal connection point for each gate is preferably located just above its associated fixed opening. As the gate swings away from the opening, the product is no longer prohibited within the bin, and it is free to be discharged from the bin. The trough-like gate is dumped when the gate is pivoted upwardly to an extent so that product therein is no longer retained by the upwardly curved elongate edges of the gate.

Specifically, a driving mechanism is provided to activate the swinging trough. A hydraulic or pneumatic motor drives a piston, which extends and retracts in response to being activated by the motor. The hydraulic piston arm is connected to a drive shaft which in turn is connected to the pivotal points of the gates, such that movement of the piston arm back and forth causes the gates to correspondingly swing back and forth. Switches on the piston can be adjusted to control the length of stroke of the piston, and accordingly, the amount of swing of the swiveling gates. During operation, the adjustable limits are preferably set so that the swivel gates will only open about half-way, or as needed by the specific product. An extreme outside limit is set for completely dumping the contents of the cooler and the gates. Time delay relays are provided which control how often the swivel gate cycles.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
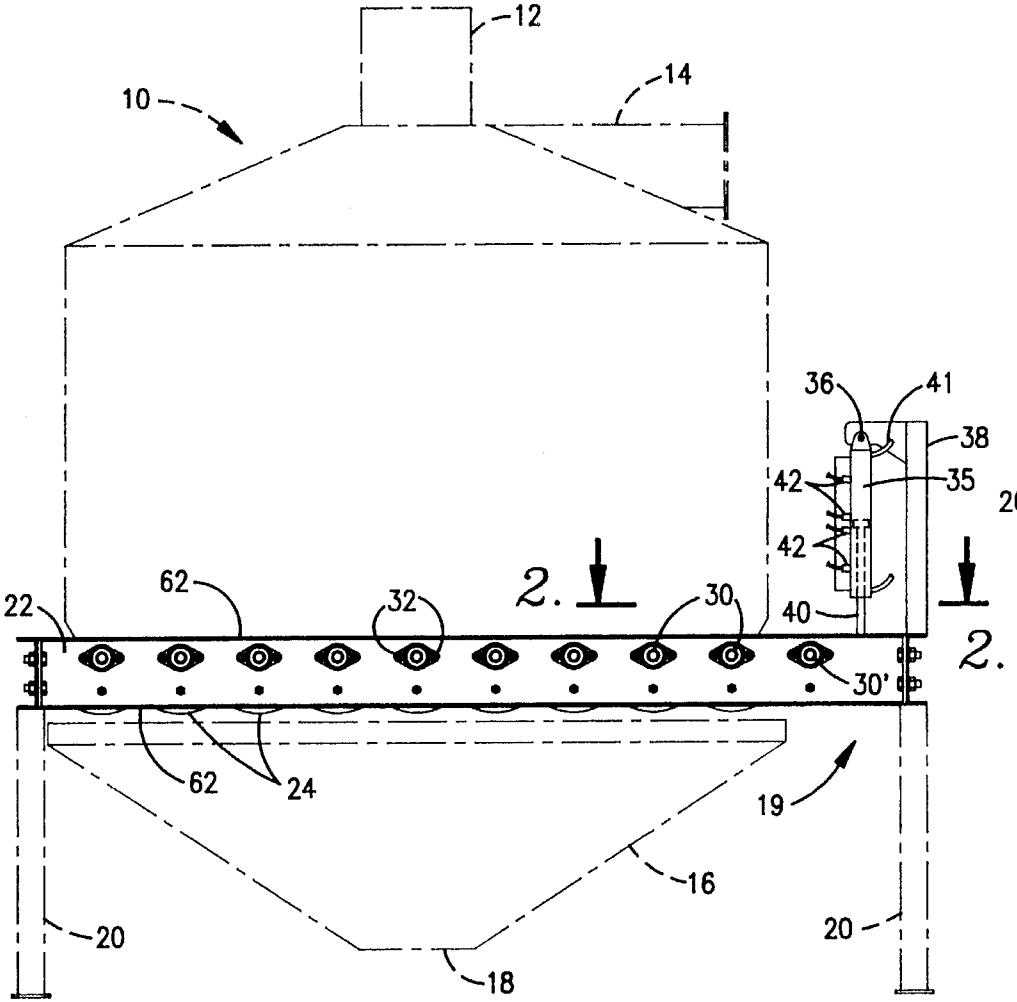
FIG. 1 is a side elevational view of the discharge mechanism of the present invention, with the cooler being shown in broken lines.

With reference initially to FIG. 1, a cooler is denoted generally by the reference numeral 10. Cooler 10 is shown in broken lines. Cooler 10 has an inlet 12, a duct 14, a hopper 16, and an outlet 18. Feed or food product is introduced into the cooler 10 at inlet 12. In this regard, cooler 10 is a large bin. Duct 14 provides an air plenum for connection to a cyclone fan. After feed or food product has been introduced into cooler 10, activation of the cyclone fan draws air upwardly through the cooler to thereby cool the product. The product within the bin is cooled by using a low volume of air with a high static pressure drop.

The discharge mechanism of the present invention is denoted generally by reference numeral 19 in FIG. 1. Discharge mechanism 19 has a frame comprised of support beams 22. Discharge mechanism 19 rests on legs 20. It will be appreciated that the substantially square cooler necessitates legs at a variety of locations, and preferably at substantially each corner of the bin.

Figure 2:
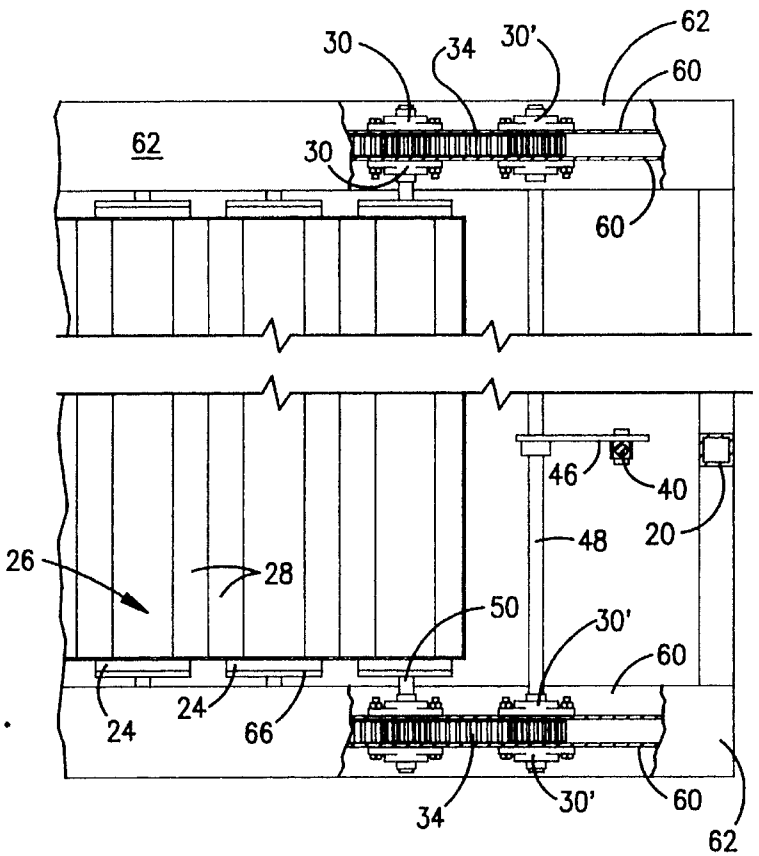
FIG. 2 is a partial top plan view taken along line 2—2 of FIG. 1.
Figure 5:
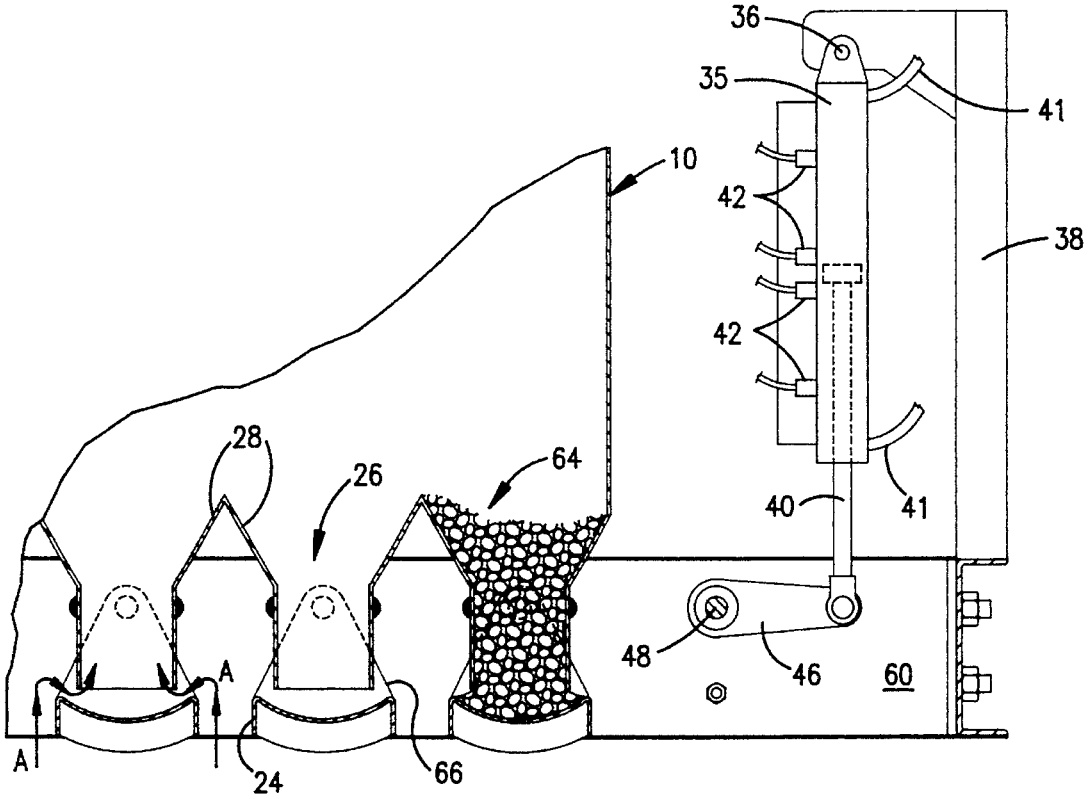
FIGS. 5–6 are partial side elevational views of the present invention illustrating operation of the invention.
Figure 6:
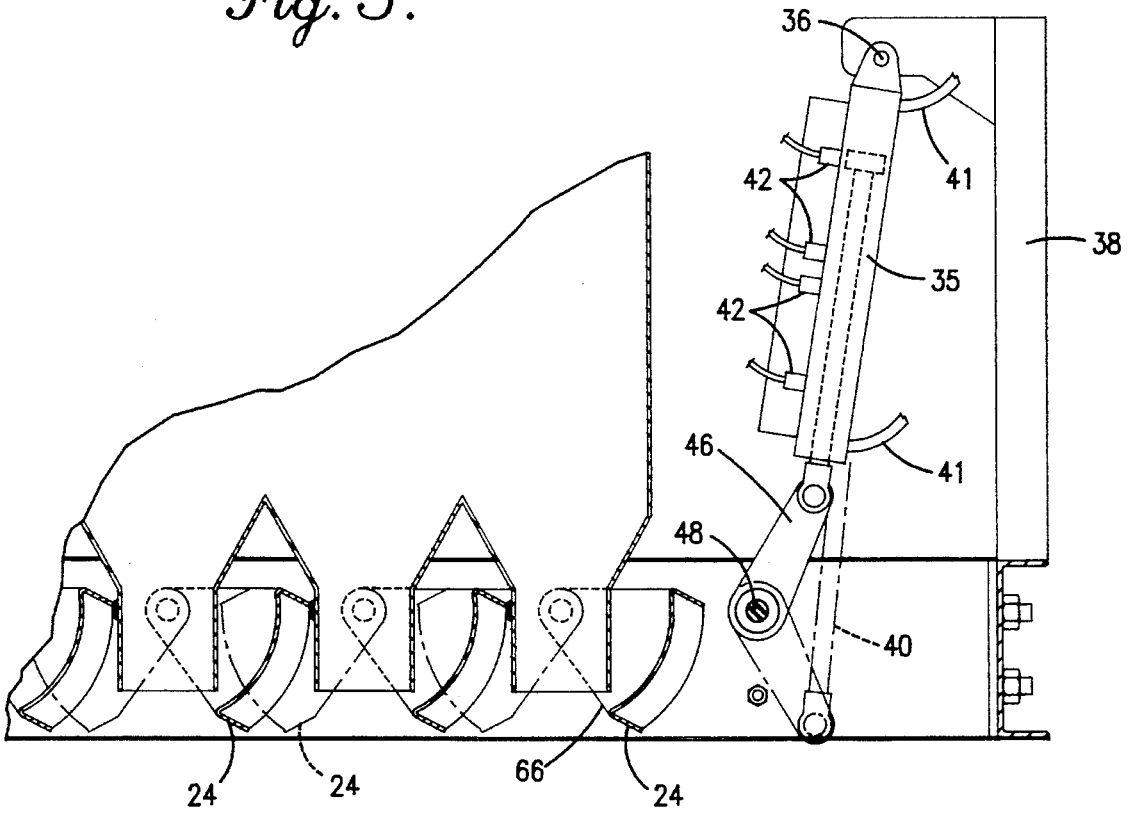

A number of swivel gates 24 are arranged in relation to fixed openings at the bottom of the cooler 10, but above the hopper 16. With reference to FIG. 2, the bottom of cooler 10 is provided with elongate fixed openings 26, which are separated by portions of the bottom of the cooler, and namely, by slats 28. As shown in FIGS. 5 and 6, slats 28 are preferably peaked to assist and direct product flow. Elongate swivel gates 24 are shown in FIGS. 1 and 2 as centered beneath the fixed openings 26. Each swivel gate 24 extends beneath an associated fixed opening 26, in a resting position, and is pivotally attached at opposite sides of the cooler 10 to support beams 22. As shown in FIGS. 5 and 6, each swivel gate 26 forms a trough.

Still with reference to FIGS. 1 and 2, it is seen that in the preferred embodiment, each swivel gate 24 has a rod 50 which is coupled to an associated bearing 30. Specifically, rod 50 engages with endplate 66 of its gate 24. Each bearing 30 is fastened to its respective support beam by fasteners 32, such as a bolt or rivet. A rack and pinion assembly, described in detail hereafter, is provided. The rack is designated in FIG. 2 by reference numeral 34. With reference again to FIG. 1, a piston 35 is pivotally attached at pivot point 36 to a bracket 38. Bracket 38 is attached to a portion of the frame of discharge mechanism 19. Piston 35 has a piston arm 40 which extends from the piston and retracts back into the piston during operation of the piston. The piston is powered by a traditional power supply, such as hydraulics or pneumatics, with associated controls. Power supply conduits are designated in FIG. 1 by reference numeral 41. Control settings are designated on the piston in FIG. 1 by positions, or switches, 42. As described hereinafter, control settings 42 are adjustable, and are used to control the stroke distance of the piston arm 40.

With reference again to FIG. 2, the piston arm 40 is connected to a crank arm 46, which is in turn fixedly attached to an axle 48. Axle 48 extends between the first set of bearings 30'. As described in detail hereinafter, operation of the piston causes the axle 48 to rotate in a back-and-forth toggling manner. As a result, the pinions move the rack, thereby swinging the gates.

Figures 3, 4:
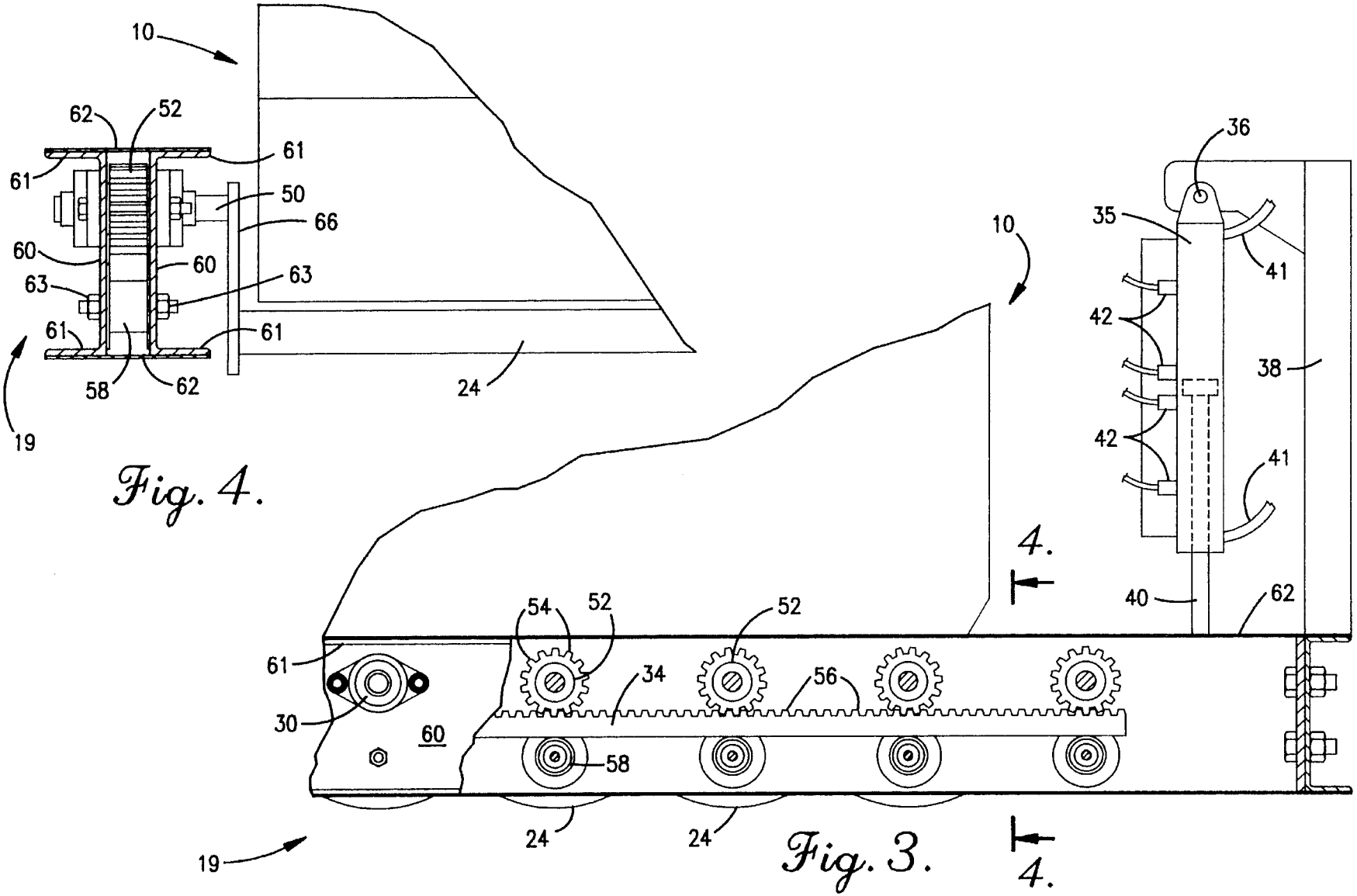
FIG. 3 is a side elevational view of one side of the discharge mechanism of the present invention with portions broken away to reveal interior components.
FIG. 4 is a cross-sectional end view taken along lines 4—4 of FIG. 3.

With reference now to FIGS. 3 and 4, the rack and pinion assembly of the present invention is described.

As seen in FIG. 3, rack 34 mates with pinions 52 in a gear-like fashion. Particularly, the teeth 54 of pinions 52 intercalate with the spaced-apart links 56 of rack 34. It will be appreciated that rotation of pinions 52 will cause the rack to be moved. As illustrated in FIGS. 2 and 4, the rack 34 wraps entirely around the outer-most pinions 52. Rollers 58 are provided beneath the rack 34, and engage the rack 34 during movement of rack 34. It should be understood that rollers 58 are provided along each side of the discharge mechanism 19, and that the side opposite to that shown in FIG. 3 is preferably identical to that shown in FIG. 3.

As seen best in FIG. 4, support beams 22 are preferably comprised of first and second upwardly standing U-shaped brackets 60, displaced from each other, and the members 61 of which U-shaped bracket extend outwardly away from the central upright portion of the bracket 60. End plates 62 cover the upper and lower ends of the beams 22 (see also FIG. 2). As seen in FIG. 4, the rack and pinion assembly and rollers 58 are positioned between brackets 60. Rollers 60 are rotatably mounted between brackets 60, such as for instance by an axle extending therethrough, the outer ends of which are held to respective brackets 60 by nuts 63.

In other embodiments, the rack and pinion assembly heretofore described may be replaced with a suitable drive mechanism. In this regard, the present invention provides means for driving, or moving, the gates for product discharge. Such drive means merely requires linking the driver (e.g., the piston) to the gates. This may be mechanically accomplished in a variety of ways. For instance, the gates may be mechanically linked to the driving mechanism by providing swivel attachments between each gate and a member moveable in response to operation of piston 36. This and other variations are within the scope of the present invention and will be readily appreciated.

With reference now to FIGS. 5 and 6, operation of the present invention is described.

As described, operation of the discharge mechanism 19, and particularly swiveling of the swivel gates 24, permits pelletized feed or food product denoted generally by the reference numeral 64, to be intermittently discharged from the fixed openings 26 of cooler 10. Particularly, in one operational state of the present invention, as shown in FIG. 5, swivel gates 24 are positioned beneath respective fixed openings 26 to thereby prohibit flow of product 64 from cooler 10. Maintaining the swivel gates 24 positioned beneath the respective fixed openings 26 is accomplished by control of piston 35. Particularly, as shown in FIG. 5, piston 35 is in a fixed, preferably upright position. Maintaining the piston in this fixed position is accomplished by control settings 42, which control the extension and retraction of piston arm 40. In this fixed location of piston 35, crank arm 46, which is pivotally connected at one end thereof to the end of piston arm 40 and at the other end thereof to axle 48, is horizontal. As described above in connection with FIG. 2, axle 48 connects with initial bearings 30' at each side of cooler 10. It will be understood that the placement of components relating to initial settings of the present invention may be varied.

During the resting state as shown in FIG. 5, a low volume of air having a high static pressure drop is drawn upwardly through cooler 10 in the direction of arrow A to cool product 64. It should be understood that an end plate 66 is positioned at each end of each swivel gate 24, and it is these end gates 66 which are pivotally connected at the bearings 30. Accordingly, air is drawn around the side edges of gates 24 along the length thereof, up through product 64, and out duct 14.

At selected times, piston 35 is activated by hydraulic or pneumatic means 41 to thereby cause piston arm 40 to stroke. The stroke of piston arm 40 is limited by control settings 42. As shown in FIG. 6, during the upward stroke piston 35 in which piston arm 40 is retracted into the chamber of piston 35, piston arm 40 draws crank arm 46 upwardly, thereby causing crank arm 46 to pivot axle 48 in a counter-clockwise direction in the perspective of FIG. 6. This action further causes the piston 35 to pivot slightly about its pivotal connection point 36, as shown. As the piston arm 40 is drawn upwardly, and accordingly the axle 48 rotates, the pinions to which axle 48 is connected similarly rotate, thereby causing movement of the rack 34. Again, it will be understood that movement of piston 35 simultaneously operates the rack and pinions at each side of cooler 10. Movement of rack 34 causes the other pinions 52 with which the rack intercalates to similarly rotate thereby causing swivel gates 24 to swing (because of their connection at end plates 66) in the manner shown in FIG. 6.

In accordance with general principles of piston operation, after the piston arm 40 has been drawn upwardly, it is plunged outwardly, subject to the limit of the lower control setting 42, such that piston arm 40 extends outwardly as shown in phantom lines in FIG. 6. This operation of piston 35 causes the crank arm and associated axle 48 to be rotated in a clockwise direction, thereby causing the swivel gates 24 to swing in the opposite direction as also shown in phantom lines. It will be appreciated that operation of the discharge mechanism 19 in this manner allows the pelletized product 64, which accumulates on the swivel gates 24 as shown in FIG. 5, to be discharged from the cooler 10 through openings 26. As described above, the product, now cooled, falls into the hopper 16 of cooler 10 and exits the hopper 16 at outlet 18.

The operation of the discharge mechanism 19 of the present invention will be readily understood in view of the foregoing description. Although operation of discharge mechanism 19, and particularly the timing control will vary depending upon the length, diameter, and density of the pellets to be cooled in cooler 10, one typical operation might result in the swivel gates being moved approximately 2 or 3 inches into an open position, and then swung back to a resting state such that the swivel gates 24 positioned beneath their respective fixed openings 26. After an appropriate time delay, which in some uses may be on the order of 8–10 seconds, the swivel gate is then swung in the opposite direction. Accordingly, the actual movement of the swivel gate may be far less dramatic than that shown in FIG. 6 and will depend upon the product to be cooled. Although it should be understood that control settings 42 of piston 35 may be set so that the piston swivels in only one direction, swiveling the gates in opposite directions upon each subsequent activation of piston 35 is preferred so that product 64 does not build up on the gates 24 at one side of a fixed opening 26. Since swivel gates 24 will rarely, if ever, be fully opened in normal discharge operation, swiveling the gates 24 in only one direction would likely result in product buildup at the side of the gate opposite the side at which it is opened.

In accordance with the principles of the present invention, the outermost control settings 42 may be set to their extreme for what is called a complete dump cycle. With such a setting, the piston arm 40 will extend and retract to its fullest extent, thereby causing the swivel gates 24 to swing fully open. In accordance with the preferred principles of the present invention, swinging the swivel gates 24 completely open in such a manner causes any product remains or dust particulates on each swivel gate 24 to be completely discharged therefrom. In other words, any product retained on the swivel gate by the upwardly curved ends thereof, is discharged because the gate swings open far enough to allow all dust, pellets, and particulate remains to fall from the gates 24. In such a manner, the trough-shaped gates are efficiently cleaned prior to introduction of further, or different, product 64 into cooler 10.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A cooler comprising:

a bin into which product to be cooled is introduced;

a plurality of fixed discharge openings positioned in a lower portion of said bin;

a plurality of gates, each gate positionable in a starting position beneath one of said discharge openings to prohibit discharge of product therefrom, wherein each said gate is adapted to be moved, from its starting position beneath its associated discharge opening, in a first direction and in a second direction opposite said first direction, whereby moving said gates from their starting positions permits at least some of said product to discharge from said cooler.

2. The cooler as set forth in claim 1 wherein said discharge openings are slots and said gates are elongate troughs.

3. The cooler as set forth in claim 2 wherein said moving means further comprises:

a rack and pinion assembly operably connected with said gates; and a piston operably connected to said rack and pinion assembly, whereby operation of said piston causes said movement of said gates.

4. The cooler as set forth in claim 3 wherein said rack and pinion assembly comprises a rack and a plurality of pinions, said gates operably connected to said pinions such that rotation of the pinions causes the gates to pivot.

5. The cooler as set forth in claim 1 wherein said gates are spatially removed from a lower end of said bin to allow air to be drawn upwardly around said gates and through said product within said bin.

6. The cooler as set forth in claim 5 wherein said gates are pivotally mounted relative to said bin, wherein said cooler further comprises a controller for swinging said gates in said first and second direction.

7. The cooler as set forth in claim 6 wherein said controller controls the timing, direction, and extent of movement of each said gate.

8. The cooler as set forth in claim 7 wherein said gates are troughs for retaining product.

9. A discharge apparatus for a cooler, said cooler comprising a bin into which product to be cooled is introduced and further having a plurality of fixed openings through which said product is discharged from said cooler, said discharge apparatus comprising:

a plurality of gates, each gate associated with one of said openings and positionable at a starting position therebeneath; and a controller for controlling movement of said gates, said controller operable to periodically move said gates from said starting position in a first direction, and to periodically move said gates from said starting position in a second direction, opposite said first direction, whereby moving said gates, in either direction, from their starting positions beneath said openings permits at least some of said product to discharge from said cooler.

10. The apparatus as set forth in claim 9 wherein said gates are troughs for retaining said product.

11. The apparatus as set forth in claim 10 wherein said moving means comprises:

a rack and pinion assembly operably connected with said gates; and a piston operably connected to said rack and pinion assembly, whereby operation of said piston causes said movement of said gates.

12. The apparatus as set forth in claim 9, wherein said gates are spatially removed from a lower end of said bin to allow air to be drawn upwardly around said gates and through said product within said bin.

13. The apparatus as set forth in claim 9, wherein said gates are pivotally mounted relative to said bin, wherein said controller is operable for swinging said gates in said first and second directions.

14. The apparatus as set forth in claim 9, wherein said controller controls the timing, direction, and extent of movement of each said gate.

15. A method of discharging product from a product cooler, said cooler comprising a bin having a plurality of fixed discharge openings at a lower portion thereof, said method comprising:

providing elements in an obstructing position for obstructing said openings to thereby inhibit the discharge of said product from said openings;

intermittently moving said elements, from said obstructing positions, in first and second directions into corresponding positions in which said discharge openings are at least partially unobstructed to allow said product to flow through said discharge openings.

16. The method as set forth in claim 15 wherein said step of intermittently moving further comprises:

moving said elements in a first direction so that said discharge openings are at least partially unobstructed;

thereafter moving said elements back into a position beneath said openings so that said product flow is obstructed; and thereafter moving said elements in a second direction, opposite that of said first direction, so that said discharge openings are at least partially unobstructed, whereby said product flows through said unobstructed areas of said discharge openings.

17. The method as set forth in claim 16 wherein said moving steps further comprise pivoting said elements in said directions.

18. A counterflow cooler for pelletized product comprising:

a bin having a product inlet at its upper end and a product discharge, comprised of a number of fixed outlet openings, at its lower end;

a plurality of movable deflectors, each deflector spaced below the lower end of said bin and pivotally mounted, at a pivot point, in relation to said bin, wherein each said deflector is positionable to obstruct one of said outlet openings; and a controller, coupled with said deflectors, for rotating each said deflector about its pivot point to thereby swing each said deflector at least partially away from its associated opening, thereby selectively discharging a quantity of pelletized product through said outlet openings.

19. The counterflow cooler as set forth in claim 18, wherein said deflectors are pivotable in first and second directions, and said controller controls the direction, extent, and timing of movement of said deflectors to thereby selectively control discharge of pelletized product through said outlet openings.

20. The counterflow cooler as set forth in claim 19, wherein said deflectors are troughs.

* * * * *

US005522152C1

(12) REEXAMINATION CERTIFICATE (4608th)

United States Patent

Woolsey

(10) Number: US 5,522,152 C1

(45) Certificate Issued: Jul. 2, 2002

(54) METHOD AND APPARATUS FOR DISCHARGING MATERIAL FROM A COOLER

(75) Inventor: Rick L. Woolsey, Olathe, KS (US)

(73) Assignee: Wenger Manufacturing, Inc., Sabetha, KS (US)

Reexamination Request:
No. 90/005,579, Dec. 2, 1999

Reexamination Certificate for:

| | |
|---|---|
| Patent No.: | **5,522,152** |
| Issued: | **Jun. 4, 1996** |
| Appl. No.: | **08/327,380** |
| Filed: | **Oct. 21, 1994** |

(51) Int. Cl.[7] ..... F26B 17/12

(52) U.S. Cl. ..... 34/168; 34/175; 34/482

(58) Field of Search ..... 34/168, 175, 498, 34/482

(56) References Cited

U.S. PATENT DOCUMENTS

| | | | | |
|---|---|---|---|---|
| 2,577,315 A | | 12/1951 | Ellerbeck | 222/135 |
| 3,358,976 A | * | 12/1967 | Siltberg | 34/168 |
| 3,795,987 A | * | 3/1974 | Kemmetmueller | 34/168 |
| 4,170,183 A | | 10/1979 | Cross | |
| 4,869,162 A | * | 9/1989 | Schouton | 34/168 |

FOREIGN PATENT DOCUMENTS

| | | | | |
|---|---|---|---|---|
| DE | 406 | | of 1877 | |
| CH | 364456 | * | 10/1962 | 34/168 |
| JP | 54-44266 | * | 4/1979 | 34/168 |
| JP | 4-62387 | * | 2/1992 | 34/168 |

OTHER PUBLICATIONS

English translation of the description of German Pat. No. 406, Filed Dec. 11, 1877.

Webster's Third New International Dictionary, copyright 1993, Title page, pp. 939, 2312 and 2313.

* cited by examiner

*Primary Examiner*—John Kwon

(57) ABSTRACT

A method and apparatus for discharging food or feed product from a cooler. Food or feed product may be introduced in a cooler formed of a large bin. The product is cooled by drawing a low volume of air having a high static pressure drop through the product. Trough-shaped gates are positionable beneath discharge openings in a lower portion of the bin to inhibit discharge of product. Product is intermittently discharged from the openings by selectively moving the gates at least partially away from the openings to permit product to flow through the openings. In preferred embodiemnts, a driver moves the gates intermittently in first and second directions by causing the gates to swing about a pivotal mounting point.

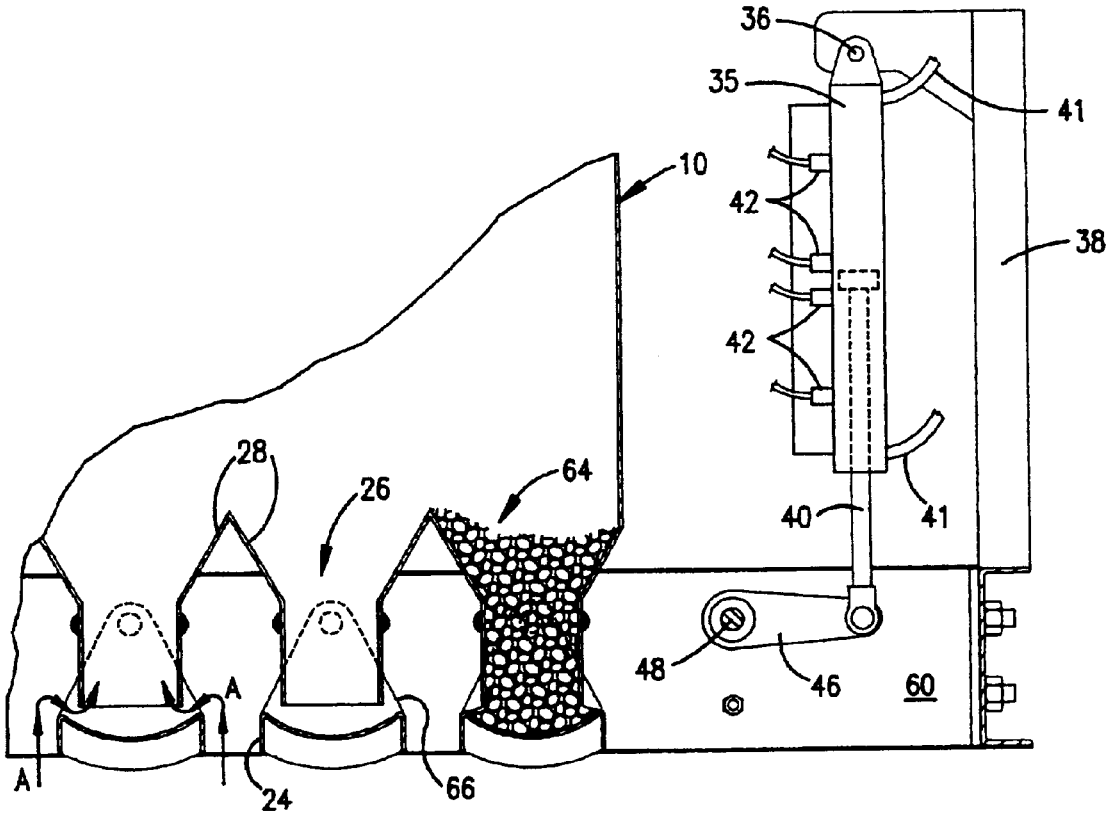

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 5, 9–14 and 17 are cancelled.

Claims 1, 3, 6, 15, 16 and 18 are determined to be patentable as amended.

Claims 2, 4, 7, 8, 19 and 20, dependent on an amended claim, are determined to be patentable.

1. A cooler comprising:

a bin into which product to be cooled is introduced;

a plurality of fixed discharge openings positioned in a lower portion of said bin;

*a duct in communication with said bin and adapted for coupling with a fan and located above said discharge openings;* a plurality of gates, each gate positionable in a starting position beneath one of said discharge openings to *hold product and* prohibit discharge of product therefrom, wherein each said gate *is pivotal about a pivot axis located vertically above the corresponding discharge opening and* is adapted to be *swingingly* moved, from its starting position beneath its associated discharge opening, in a first direction and in a second direction opposite said first direction, whereby [moving] *swinging* said gates from their starting positions permits at least some of said product to discharge from said cooler*, each of said gates spaced below a corresponding discharge opening to define a cooling air passageway therebetween,*

*said duct and cooling air passageways configured for drawing cooling air upwardly through said cooling air passageways and said held product for cooling thereof.*

3. The cooler as set forth in claim 2 [wherein said moving means further comprises] *further comprising*;

a rack and pinion assembly operably connected with said gates; and a piston operably connected to said rack and pinion assembly, whereby operation of said piston causes said *swinging* movement of said gates.

6. The cooler as set forth in claim [5 wherein said gates are pivotally mounted relative to said bin,] *1,* wherein said cooler further comprises a controller for swinging said gates in said first and second direction.

15. A method of discharging product from a product cooler, said cooler comprising a bin having a plurality of fixed discharge openings at a lower portion thereof, said method comprising:

providing elements in obstructing position for obstructing said openings to thereby *hold product in the elements and* inhibit the discharge of said product from said openings*, said elements each being pivotal about an axis located vertically above corresponding elements and spaced below corresponding openings to define cooling air passageways;*

*drawing cooling air currents upwardly through said cooling air passageways and said product held thereby to cool the product; and* intermittently [moving] *swinging* said elements, from said obstructing positions, in first and second directions into corresponding positions in which said discharge openings are at least partially obstructed to allow said product to flow through said discharge openings.

16. The method as set forth in claim 15 wherein said step of intermittently [moving] *swinging* further comprises:

[moving] *swinging* said elements in a first direction so that said discharge openings are at least partially unobstructed;

thereafter [moving] *swinging* said elements back into a position beneath said openings so that said product flow is obstructed; and thereafter [moving] *swinging* said elements in a second direction, opposite that of said first direction, so that said discharge openings are at least partially unobstructed, whereby said product flows through said unobstructed areas of said discharge openings.

18. A counterflow cooler for pelletized product comprising:

a bin having a product inlet at its upper end and a product discharge, comprised of a number of fixed outlet openings, at its lower end;

*a duct in communication with said bin and adapted for coupling with a fan and located above said discharge openings;* a plurality of movable deflectors, each deflector spaced below the lower end of [said bin] *a corresponding outlet opening to define cooling air passageways between each deflector and the corresponding outlet opening, each deflector* [and] pivotally mounted, at a pivot point, in relation to said bin[,] *above the corresponding fixed outlet opening*, wherein each said deflector is positionable to *hold product and* obstruct one of said outlet openings; and a controller, coupled with said deflectors, for rotating each said deflector about its pivot point to thereby swing each said deflector at least partially away from its associated opening, thereby selectively discharging a quantity of pelletized product through said outlet openings*,*

*said duct and cooling air passageways configured for drawing cooling air upwardly through said cooling air passageways and said held product for cooling thereof.*

* * * * *